United States Patent [19]

Greenspan

[11] Patent Number: 4,530,447

[45] Date of Patent: Jul. 23, 1985

[54] DISPENSER

[76] Inventor: Donald J. Greenspan, 235 Pavilion Ave., Riverside, N.J. 08075

[21] Appl. No.: 631,511

[22] Filed: Jul. 17, 1984

Related U.S. Application Data

[63] Continuation of Ser. No. 330,940, Dec. 15, 1981, abandoned, which is a continuation-in-part of Ser. No. 228,636, Jan. 26, 1981, abandoned.

[51] Int. Cl.[3] ..... G01F 11/26

[52] U.S. Cl. ..... 221/288; 222/543; 221/312 C

[58] Field of Search ..... 221/1, 186, 188, 189, 221/191, 194, 288, 312 R, 312 L; 222/142.1, 543, 454, 456, 544, 546, 547, 556, 562, 563; 206/528; 220/93, 233, 256, 307

[56] References Cited

U.S. PATENT DOCUMENTS

| | | | |
|---|---|---|---|
| 716,257 | 11/1902 | Lunt . | |
| 955,480 | 4/1910 | Shea . | |
| 1,248,345 | 11/1917 | Kunkler | 222/142.1 |
| 1,352,650 | 9/1920 | Blanchard . | |
| 2,024,495 | 12/1935 | Wolfe | 220/233 |
| 2,211,120 | 8/1940 | Holland | 221/288 X |
| 2,219,422 | 10/1940 | Jordan | 221/288 |
| 2,787,296 | 4/1957 | O'Malley . | |
| 2,838,214 | 6/1958 | Kimball . | |
| 2,885,124 | 5/1959 | Green et al. | 206/528 X |
| 2,957,503 | 10/1960 | Stifter . | |
| 2,962,190 | 11/1960 | Horland . | |
| 3,004,566 | 10/1961 | Raimo . | |
| 3,033,420 | 5/1962 | Thomas et al. . | |
| 3,043,483 | 7/1962 | Vogt . | |
| 3,067,787 | 12/1962 | Salk . | |
| 3,160,327 | 12/1964 | Porcelli | 222/546 X |
| 3,164,289 | 1/1965 | Cocchiarella | 220/93 |
| 3,182,694 | 5/1965 | Raimo . | |
| 3,205,919 | 9/1965 | Kovacs . | |
| 3,289,885 | 12/1966 | Villaveces | 221/288 |
| 3,383,013 | 5/1968 | Szokely . | |
| 3,413,975 | 12/1969 | Hein . | |
| 3,473,701 | 10/1969 | Bates | 222/454 X |
| 3,480,182 | 11/1969 | Rigor . | |
| 3,610,468 | 10/1971 | Borsum . | |
| 3,622,041 | 11/1971 | Borsum et al. . | |
| 3,637,109 | 1/1972 | Stifter . | |
| 3,638,688 | 2/1972 | Conklin et al. . | |
| 3,833,147 | 9/1974 | Borsum et al. . | |
| 4,001,928 | 1/1977 | Schweiso | 220/307 X |
| 4,006,557 | 2/1977 | Sawyer . | |
| 4,027,776 | 6/1977 | Douglas | 220/307 X |
| 4,187,964 | 2/1980 | Bogart | 222/546 |

FOREIGN PATENT DOCUMENTS

| | | |
|---|---|---|
| 963119 | 6/1950 | France . |
| 1408749 | 7/1965 | France . |
| 289333 | 3/1953 | Switzerland . |
| 359368 | 2/1962 | Switzerland . |
| 393646 | 6/1933 | United Kingdom . |
| 612036 | 11/1948 | United Kingdom . |
| 665182 | 1/1952 | United Kingdom . |
| 714049 | 8/1954 | United Kingdom . |
| 821070 | 9/1959 | United Kingdom . |
| 875889 | 8/1961 | United Kingdom . |
| 1066912 | 4/1967 | United Kingdom . |
| 2050302 | 1/1981 | United Kingdom . |

*Primary Examiner*—Joseph J. Rolla
*Assistant Examiner*—Kevin P. Shaver
*Attorney, Agent, or Firm*—Panitch, Schwarze, Jacobs & Nadel

[57] ABSTRACT

A dispenser is provided for dispensing one or more items, such as pills from a container. The dispensing member is located at or near the top of the container and has an aperture. When the container is closed by a cover and inverted, an item such as a pill passes through the aperture and is positioned between the cover and the top surface of the dispensing member. When the container is turned back to its initial position and the cover removed, a pill can easily be taken off the outer surface of the dispensing member. The dispensing member may form part of the container; may be inserted as a separate member in the container; or it may be located in the cover for the container.

27 Claims, 39 Drawing Figures

FIG. 1
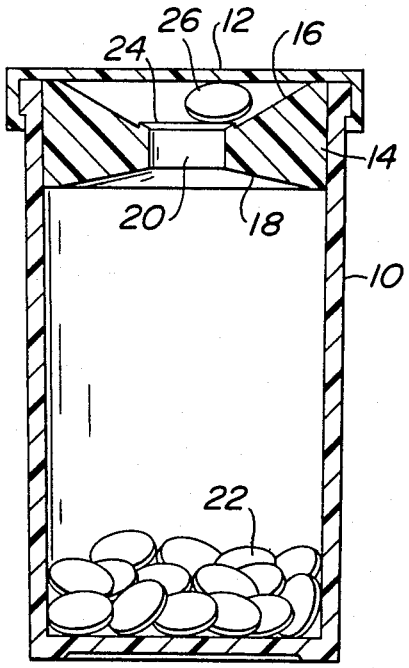
FIG. 2
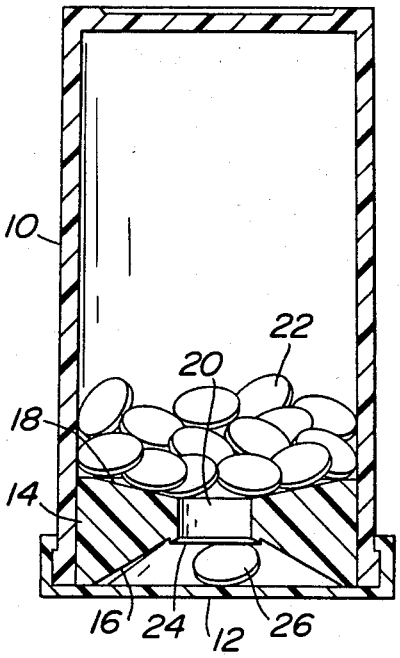
FIG. 3
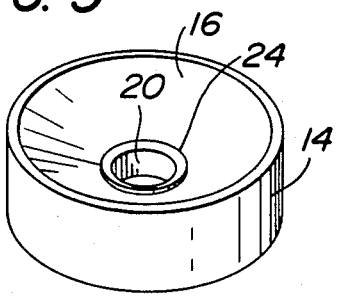
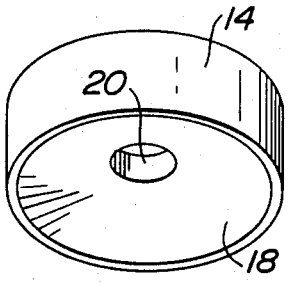
FIG. 4
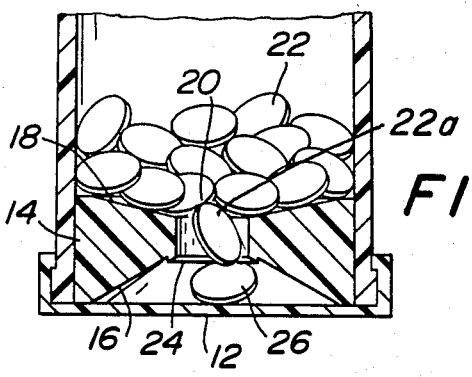
FIG. 2a FIG. 5
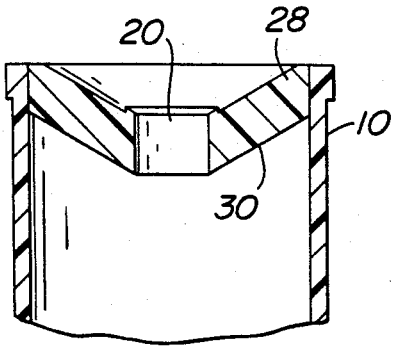
FIG. 6
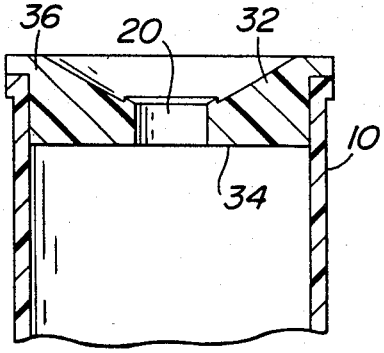
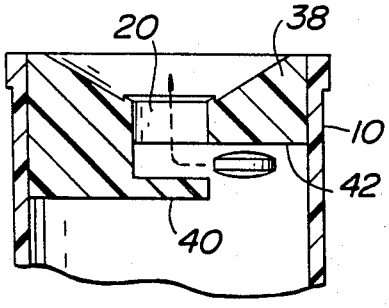
FIG. 7
FIG. 8
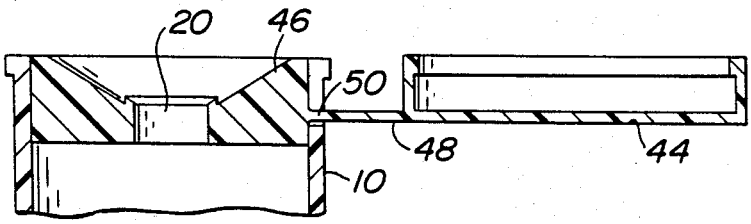

FIG. 9
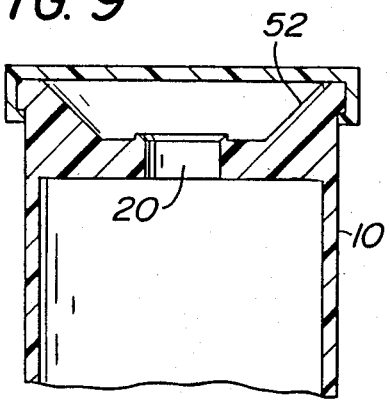
FIG. 11
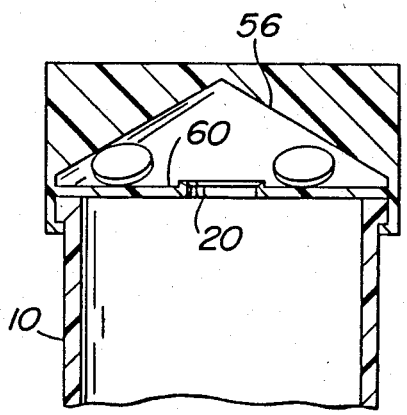
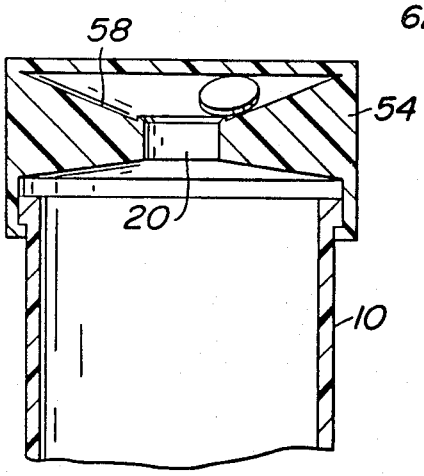
FIG. 10
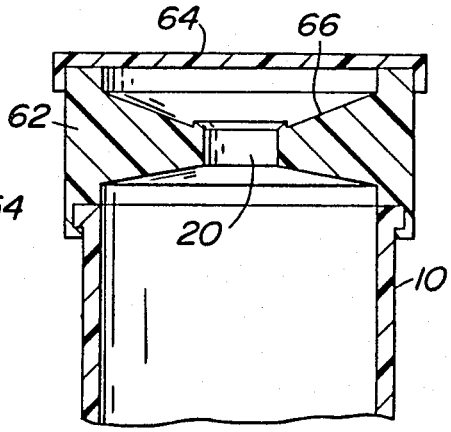
FIG. 12

FIG. 13
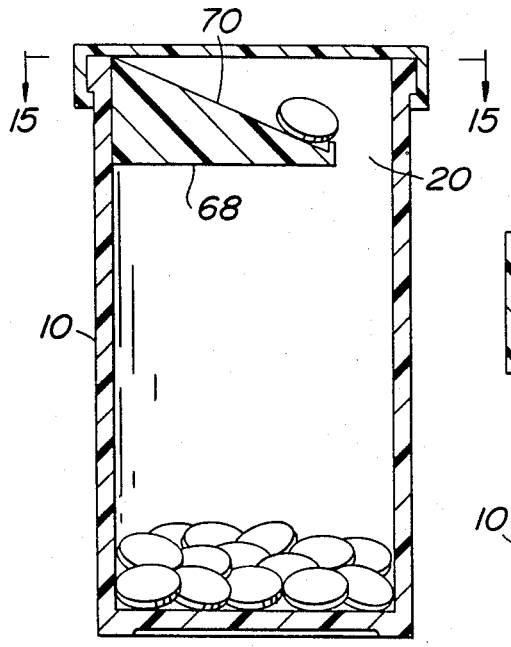
FIG. 14
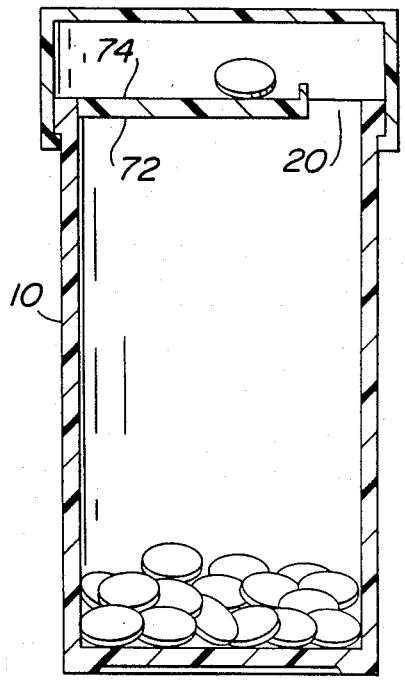
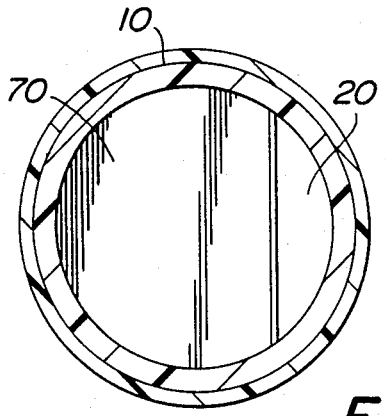
FIG. 15

FIG. 18
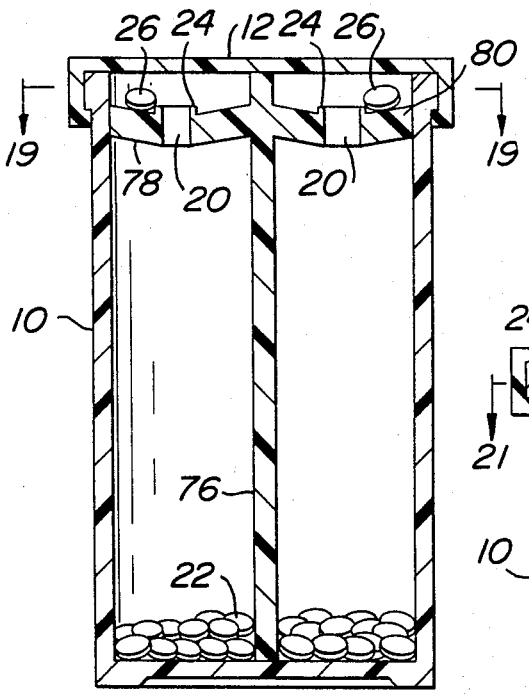
FIG. 20
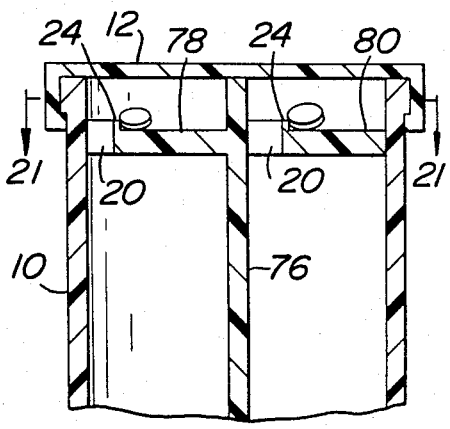
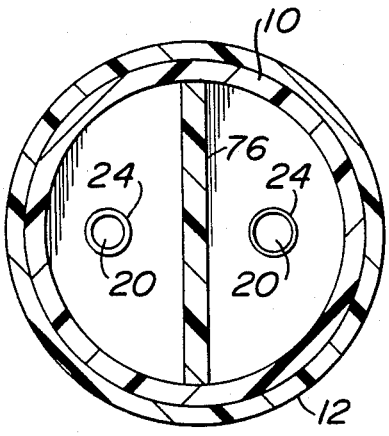
FIG. 19
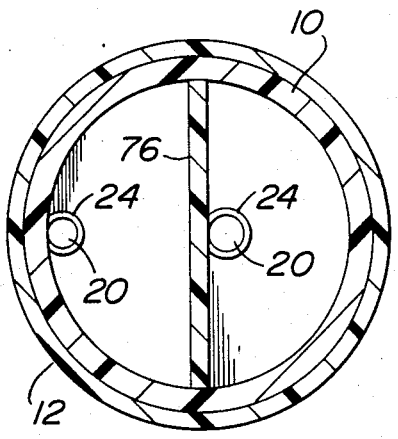
FIG. 21

FIG. 22
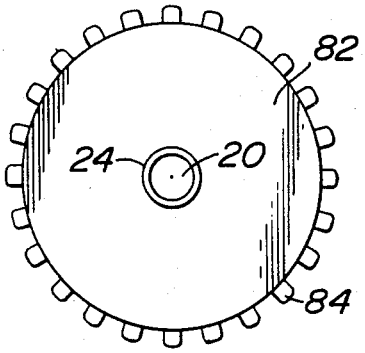
FIG. 24
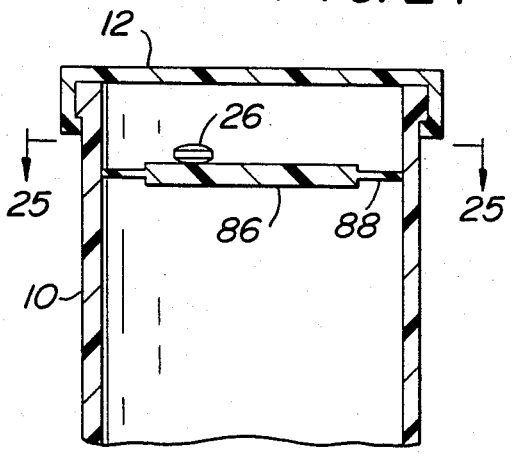
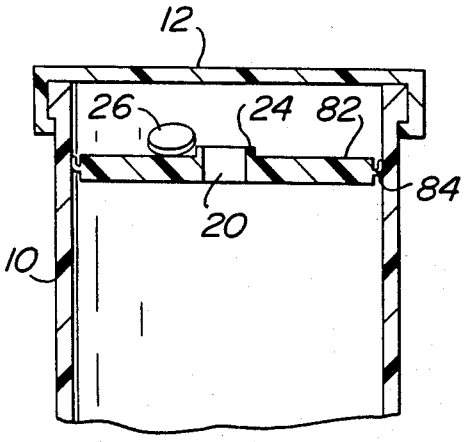
FIG. 23
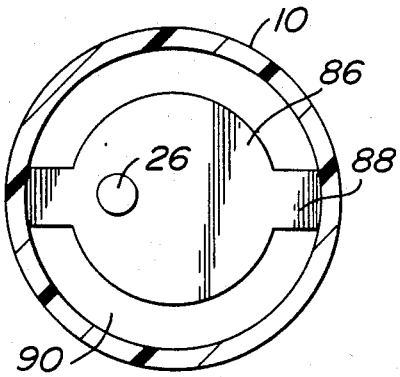
FIG. 25

FIG. 26
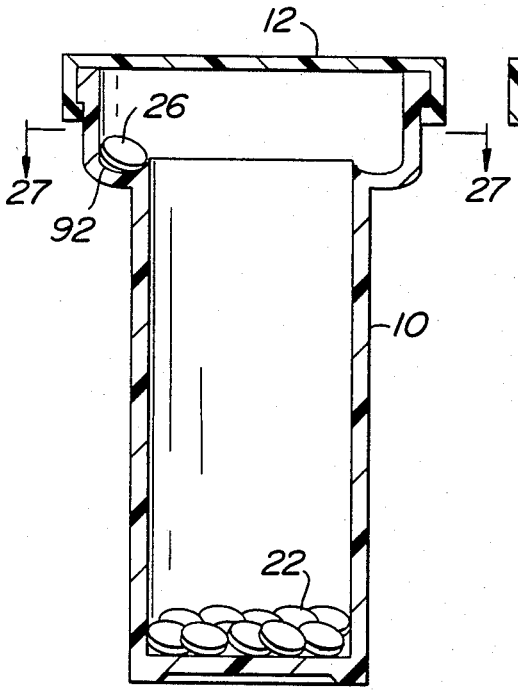
FIG. 28
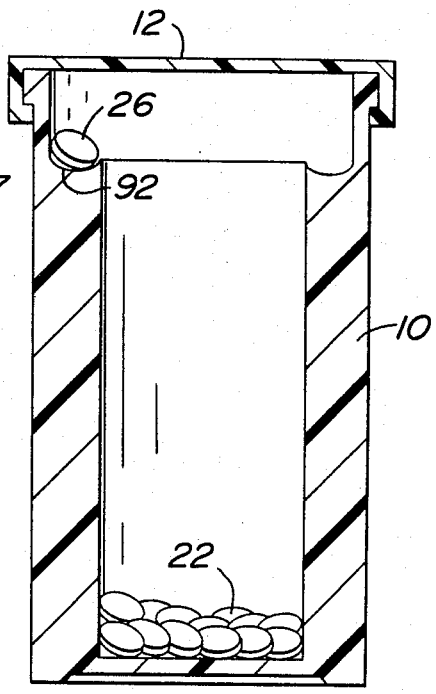
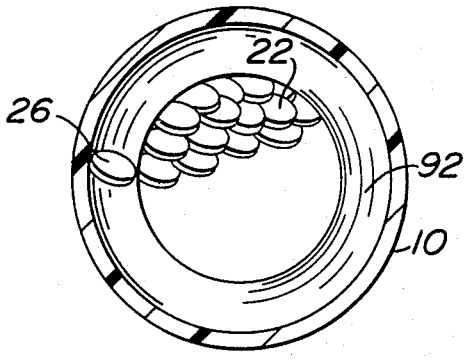
FIG. 27
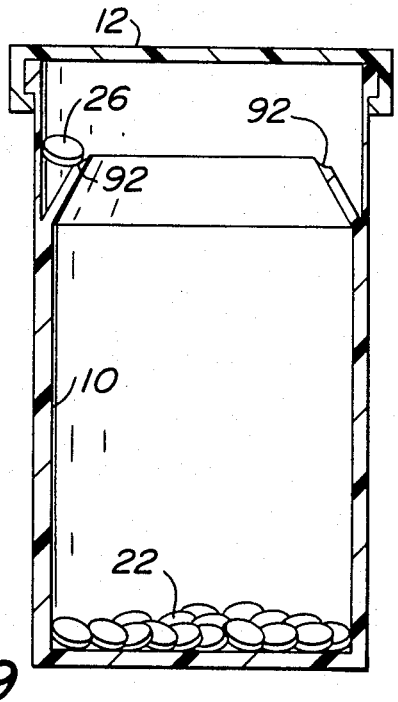
FIG. 29

FIG. 32
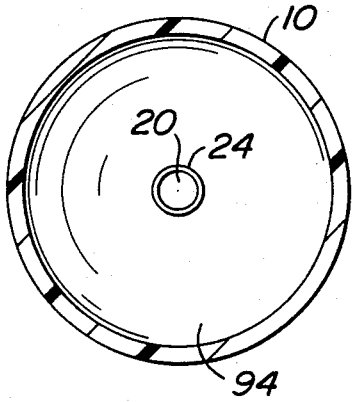
FIG. 33
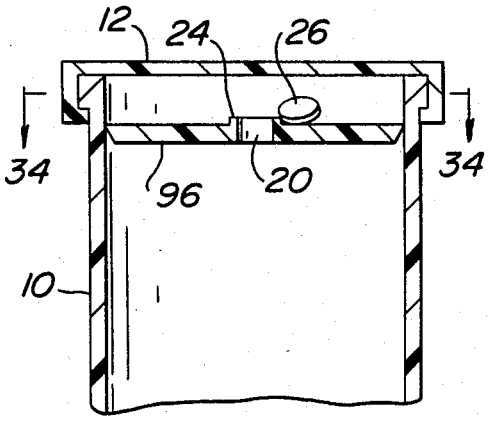
FIG. 31
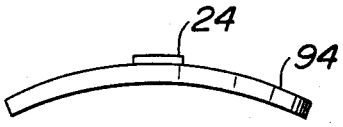
FIG. 30
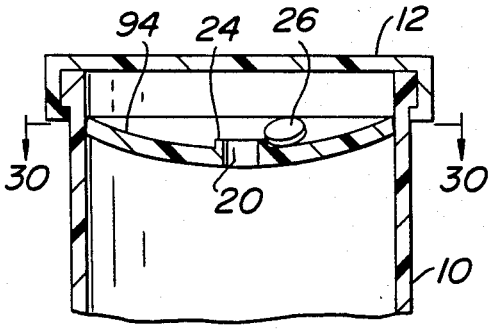
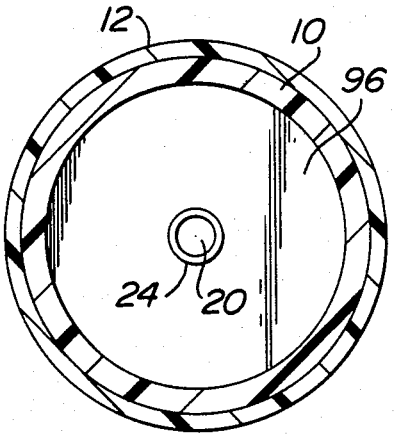
FIG. 34

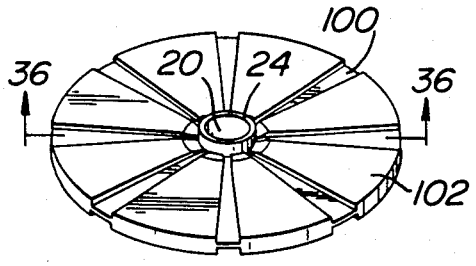
FIG. 35
FIG. 37
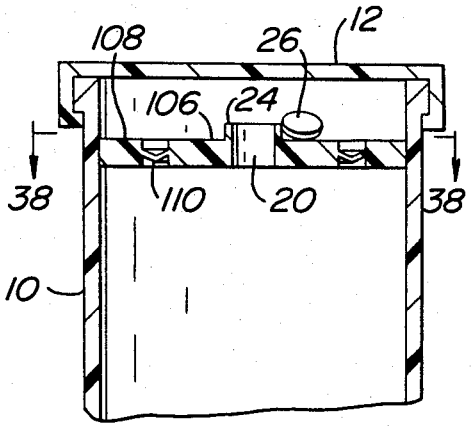
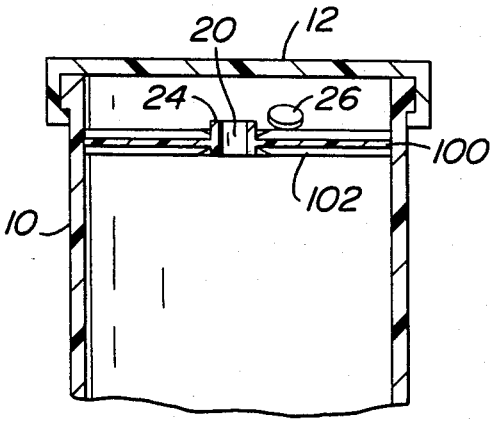
FIG. 36
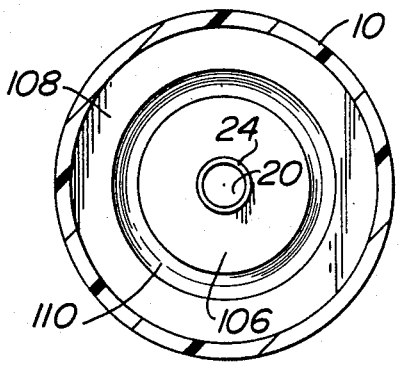
FIG. 38

DISPENSER

CROSS-REFERENCE TO RELATED APPLICATION

This application is a continuation of co-pending patent application Ser. No. 330,940, filed Dec. 15, 1981, now abandoned, which in turn is a continuation-in-part of co-pending patent application Ser. No. 228,636, filed Jan. 26, 1981, now abandoned.

BACKGROUND OF THE INVENTION

This invention relates to the dispensing of items from a coverable container. This invention also concerns relocating items in a container from a position adjacent to the bottom thereof to a position adjacent to the top thereof. More particularly, this invention concerns a dispenser apparatus in a container such as a pill bottle or vial or the cap of such container to dispense one or more pills at a time easily and without contaminating the remaining pills.

In the past decade, there has been a great deal of attention directed to developing "kiddyproof" containers for pharmaceuticals in pill, tablet, and capsule form. Accordingly, the serious problem of accidential overdosage of young children has been greatly alleviated by the proliferation of many ingenious container closures and pill dispensers.

In U.S. Pat. Nos. 3,067,787; 3,622,041; 3,637,109 and 3,833,147, resilient diaphragms with central openings are utilized in order to dispense pills. All of the devices disclosed in these patents require some manipulation and/or pressure in order to engage the pill in a socket or pocket located in the cover of the pill container. The above-described patents are more concerned with making pill containers "kiddyproof", than with making pill dispensing easier.

The problem of ease of pill dispensing is diametrically opposed to the problem of making pill containers "kiddyproof". A patient who suffers from arthritis, for example, is not so much concerned with taking an overdose of pills, as with being able to easily get a pill out of a pill bottle. It would be quite advantageous to dispense pills without having to reach down to the bottom of a bottle, or spilling out all of the pills and contaminating the same, when the patient only wants to take one or two pills. The present invention alleviates these problems and makes pill dispensing a much easier and more sanitary process.

SUMMARY OF THE INVENTION

There has now been discovered a dispenser apparatus for dispensing at least one item at a time from a container holding items to be dispensed. The dispenser apparatus has a dispensing member disposed in the container which can be formed as part of the container, inserted as a separate member in the container, or associated with the cover for the container. The container has an opening at least at one end thereof through which items can be dispensed. The dispensing member has at least one aperture. The aperture is at least slightly larger than the diameter of the largest item desired to be dispensed. The dispensing member usually has an inner surface juxtaposed to the items held in the container and an outer surface juxtaposed to the open end of the container. The outer surface of the dispensing member has means for receiving and retaining items dispensed through the aperture.

The container can have an openable cover overlying the opening such that when the container is turned upside down and then turned at least partially rightside up with the cover over the opening, the dispensed item is deposited on the outer surface of the member. The outer surface of the member is of sufficient size and shape to support at least one dispensed item which passes through the aperture. When the cover is disengaged from the container, the dispensed item is available for access on the outer surface of the dispensing member.

In some instances, the container can be fully righted whereas in other instances it is preferable to keep the container tilted (partially righted) as the pill is removed.

A further aspect of this invention concerns a dispenser apparatus for dispensing at least one item at a time in which the dispensing member is disposed in a cover for the container. The dispenser apparatus includes a container having an opening at least at one end thereof through which items can be dispensed with an openable cover overlying said opening. The container holds items for dispensing. The dispensing member in the cover has at least one aperture and the aperture is at least slightly larger than the diameter of the largest item desired to be dispensed. The member has an inner surface juxtaposed to the opening of the container and an outer surface juxtaposed to the top surface of the cover. The outer surface of the member is of a sufficient size and shape to support at least one dispensed item which passes through the aperture when the container is turned upside down and then turned at least partially rightside up.

This invention also concerns an apparatus for relocating at least one item at a time from a first location to a second location which is higher than the first location. The apparatus has a lower chamber containing the items in the first location to be relocated and an upper chamber for relocation of the items to the second location. The upper chamber has a bottom opening communicating with the lower chamber, a top opening and a relocation member. The member has at least one aperture therethrough which is at least slightly larger than the diameter of the largest item desired to be relocated. The member also has an inner surface juxtaposed to the bottom opening and an outer surface juxtaposed to the top opening. The outer surface of the member further has means for receiving and retaining items passed through the aperture.

The relocation apparatus can also have an openable cover overlying the top opening in the upper chamber. The outer surface of the member is of a sufficient size and shape to support items which pass through the aperture in the member from the lower chamber to the upper chamber when the apparatus is turned upside down and then turned at least partially rightside up with the cover over the top opening of the upper chamber. The relocated item is then available for access on the outer surface of the member upon the disengagement of the cover from the upper chamber.

This invention also relates to an apparatus for relocating at least one item at a time from a first location to a higher second location in which the relocation member is located in a cover. The relocation apparatus includes a lower chamber containing the items in said first location to be relocated and an upper chamber for relocation of the items to the second location. The upper chamber has a bottom opening communicating with the lower chamber, a top opening, an openable cover overlying the top opening and a member disposed within said cover. The member has at least one aperture therethrough. The aperture is at least slightly larger than the diameter of the largest item desired to be relocated. The member also has an inner surface juxtaposed to the top opening and an outer surface juxtaposed to the top surface of the cover. The outer surface of the member is a sufficient size and shape to support items which pass from the lower chamber through the aperture when the apparatus is turned upside down and then turned at least partially rightside up.

This invention also concerns methods for dispensing and relocating items. One method for dispensing items involves locating the dispensing member adjacent to the opening in the container and inverting the container (from an initial position with its opening facing upward) to allow one or more items to pass through the aperture. The container is then turned back to its initial position so as to allow the items which passed through the aperture to be received on retaining means on the outer surface of the dispensing member. Furthermore, an openable cover can be provided for overlying the opening in the container. The container's opening is covered when the container is inverted. After the container is turned back toward its initial position, items passing through the aperture are received on retaining means on the outer surface of the dispensing member. The cover is then disengaged from the container and dispensed items are removed from the outer surface of the member.

Another method for dispensing at least one item at a time from a container for holding items to be dispensed concerns a container having an opening at least at one end thereof through which items can be dispensed with an openable cover overlying the opening. A dispensing member is provided within the cover for the container. The member has at least one aperture. The aperture is at least slightly larger than the diameter of the largest item desired to be dispensed. The member also has an inner surface juxtaposed to the opening of the container and an outer surface juxtaposed to the top surface of the cover. The container has an initial position in which the opening faces upward. The container is inverted from the initial position with the cover over the opening to allow one or more items to pass through the aperture. The container is then turned toward its initial position so as to allow the items passing through the aperture to be received on retaining means on the outer surface. The cover is then disengaged from the container and the dispensed items are removed.

A method for relocating items from a first position to a higher second position involves providing the relocation member adjacent to the top opening in the plane of the second position. The method includes inverting the two chambers from an initial position with the opening in the top chamber facing upward to allow one or more items to pass through the aperture. The chambers are then turned backward to their initial position to allow the items which passed through the aperture to be received on retaining means on the outer surface. Furthermore, an openable cover can be provided for overlying the top opening of the upper chamber. The cover is engaged over the top opening when the chambers are inverted and removed to take relocated items off the outer surface after the items have passed through the aperture of the member and have been received on the retaining means of the member.

The invention also concerns another method for relocating at least one item at a time from a first location to a higher second location. The method comprises providing a dispensing member within an openable cover overlying a top opening for an upper chamber. The upper chamber has a bottom opening communicating with a lower chamber. The lower chamber contains items to be relocated from the first location. The member has at least one aperture therethrough. The aperture is slightly larger than the diameter of the largest item desired to be relocated. The member also has an inner surface juxtaposed to the top opening and an outer surface juxtaposed to the top surface of the cover. The upper chamber has an initial position in which the opening thereof faces upward. The chambers are inverted from the initial position with the cover over said top opening to allow one or more items passing through the aperture to be received on retaining means on said outer surface. The cover is then disengaged from the upper chamber and the relocated items are removed.

BRIEF DESCRIPTION OF THE DRAWINGS

For the purpose of illustrating the invention, there are shown in the drawings forms which are presently preferred; it being understood, however, that this invention is not limited to the precise arrangements and instrumentalities shown.

FIG. 1 is a partial sectional view of one embodiment of a dispenser/relocater apparatus of this invention.

FIG. 2 is a partial sectional view of the apparatus of FIG. 1, but with the container being in the inverted position.

FIG. 2*a* is a partial sectional view of the apparatus of FIG. 1, but with the container being in the inverted position and illustrating that a dispensed pill acts to block the dispensing of further pills.

FIG. 3 is a perspective detail, on an enlarged scale, showing the dispensing member of FIGS. 1 and 2 with the outer surface visible.

FIG. 4 is a perspective detail, on an enlarged scale, showing the dispensing member of FIGS. 1 and 2 with the inner surface visible.

FIG. 5 is a partial sectional view of a container having another form of a dispensing member in accordance with this invention. This dispensing member has a concave outer surface and a convex inner surface.

FIG. 6 is a partial sectional view of a container having a further form of a dispensing member in accordance with this invention. This dispensing member has a concave sloping outer surface and a straight (flat) inner surface.

FIG. 7 shows a partial sectional view of a container having still another dispensing member in accordance with this invention. This dispensing member has a concave outer surface and a straight (flat) inner surface having a baffle (shelf) disposed beneath the centrally located aperture.

FIG. 8 shows a partial sectional view of the apparatus as shown in FIG. 6 with a cover for the container attached to the dispenser.

FIG. 9 is a partial sectional view of a container having a further embodiment of a dispensing member formed integral with the container in accordance with this invention. The dispensing member has an outer surface which forms a partial frusto-conical section and a flat inner surface.

FIG. 10 is a partial sectional view of a container having a dispensing member located in the cover (cap) of the container.

FIG. 11 is a partial sectional view of a container having another embodiment of a dispensing member located in the cover (cap) of the container.

FIG. 12 is a partial sectional view of a container having a removably engageable dispensing member with a removably engageable lid.

FIG. 13 is an elevational view of a dispensing member with a non-centrally located aperture.

FIG. 14 is an elevational view of a dispensing member with a non-centrally located aperture and a flat outer surface.

FIG. 15 is a top plan view of the dispensing apparatus shown in FIGS. 13 and 14.

FIG. 18 is an elevational view of a dispensing apparatus longitudinally segmented into two compartments with each compartment having its own dispensing member with a centrally located aperture thereto.

FIG. 19 is taken along line 19—19 of FIG. 18 and shows a top plan view of the segmented dispensing apparatus.

FIG. 20 is a partial sectional view of a dispensing apparatus longitudinally segmented into two compartments with each compartment having its own dispensing member with non-centrally located apertures.

FIG. 21 is taken along line 21—21 of FIG. 20 and shows a top plan view of the segmented dispensing apparatus.

FIG. 22 is a top plan view of an insertable dispensing member having flexible nipples on the outer circumference thereof.

FIG. 23 is a partial sectional view of the dispensing member of FIG. 20 disposed in a container.

FIG. 24 is a partial sectional view of a dispensing apparatus wherein the dispensing member has a smaller diameter than the container with flanges holding the dispensing member in place. This dispensing apparatus thus provides for an annular aperture for dispensing.

FIG. 25 is a top plan view taken along line 25—25 of FIG. 24.

FIG. 26 is an elevational view of a dispenser apparatus in accordance with this invention wherein a ledge is provided on the circumference of the container.

FIG. 27 is a top plan view taken along line 27—27 of FIG. 26.

FIG. 28 is an elevational view of a dispenser apparatus wherein a ledge is provided on the circumference of the container by the thick side wall of the container.

FIG. 29 is an elevational view of a dispenser apparatus wherein a ledge is provided on the circumference of the container by a projection formed from the thin side wall of the container.

FIG. 30 is a partial sectional view of a dispenser apparatus in accordance with this invention wherein the dispensing member is a flat disc.

FIG. 31 is a side plan view of the dispensing member depicted in FIG. 30 before insertion in a container.

FIG. 32 is a top plan view taken along line 30—30 of FIG. 30.

FIG. 33 is a partial sectional view of a dispenser apparatus in accordance with this invention wherein the circumference of the dispensing member is tapered.

FIG. 34 is a top plan view taken along line 34—34 of FIG. 33.

FIG. 35 is a perspective view of a dispensing member in accordance with this invention.

FIG. 36 is a partial sectional view of a dispenser apparatus utilizing the dispensing member depicted in FIG. 35. The depiction of the dispensing member is taken along line 36—36 of FIG. 35.

FIG. 37 is a partial sectional view of a dispensing apparatus having a dispensing member composed of two annular rings with a live hinge interposed between the rings.

FIG. 38 is a top plan view taken along line 38—38 of FIG. 37.

DETAILED DESCRIPTION OF THE INVENTION

Figure 16:
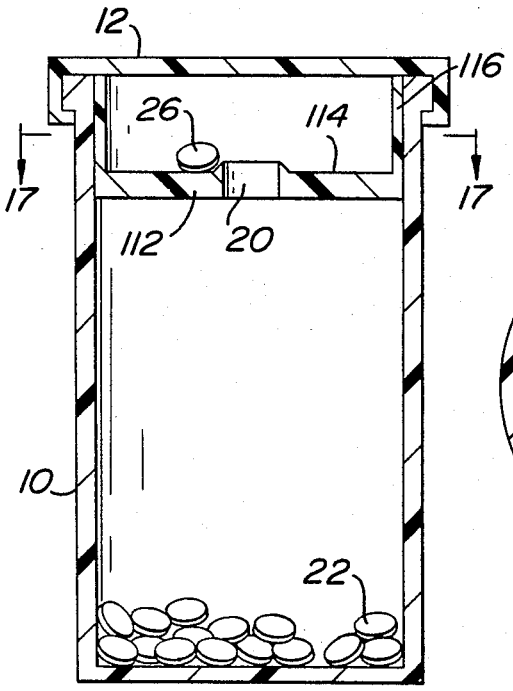
FIG. 16 is a partial sectional view of a container having a dispensing member with its outer surface generally flat and generally perpendicular to its side wall.

Although the dispenser of this invention can be utilized for a wide variety of items, it is particularly useful to dispense pharmaceuticals in the form of pills, tablets, capsules, etc. from vials and bottles.

The dispensing member of this invention is optimally located at or near the top of a container, adjacent to the opening of the container. The dispensing member can be located either inside the container itself (such as formed as part of the container, or as a separate member inserted therein) or within a cover for the container. This invention can also serve to relocate items from a position adjacent to the bottom of a container to a new position adjacent to the top of the container for ease of removal.

The dispensing member has an aperture. The aperture can be positioned anywhere on the dispensing member. It is preferred that the aperture be adjacent to the side of the container and most preferred that the aperture be generally centrally located. The aperture can have any convenient shape such as circular, semi-circular, truncated circular section, square, rectangular, etc. The aperture can be fitted with a removable plug. Furthermore, the aperture can be tapered to lead pills and especially capsules for dispensing and relocating.

In a preferred embodiment, the outer surface of the dispensing member forms at least a partial frusto-conical surface which slopes downward from the rim of the open end of the container. The angle of the slope from the horizontal is between about 5° and about 90°, preferably between about 10° and 35°. The outer surface can also form a complete frusto-conical section. Alternatively, the outer surface can slope down at an angle as given above and then proceed horizontally for a distance before terminating in a centrally positioned aperture. This outer surface can thus form a "partial" frusto-conical section.

If desired, the outer surface of the dispensing member can have a rough texture, for example, having ridges, grooves, or undulations, to prevent the dispensed item from slipping back through the aperture. It is also preferred that there be a slightly raised rim around the circumference of the aperture to prevent dispensed items from falling back into the container.

The inner and outer surfaces of the dispensing member can be either straight or sloped. If sloped, the shape could be either concave or convex. A shelf or baffle can be placed underneath the aperture to further aid in the dispensing of items.

The dispensing member can be constructed from any suitable material. When used in conjunction with pharmaceuticals, the material should be sanitary to avoid contamination of the medicine. Non-limiting examples of suitable materials are plastic and rubber, preferably a relatively rigid, pliable plastic.

The shape of the dispensing member will be dictated by the shape of the container it is associated with. A cylindrical container would thus require a cylindrical dispensing member.

The container in which the dispensing member is disposed has an opening at least at one end thereof. Preferably, the container has a cover to close said opening. The cover can be removably engageable. Alternatively, one's hand can operate as a cover.

The number of pills dispensed or relocated from the bottom to the top of the pill vial is a function of one or more variables. These variables include the degree of the slope of the outer surface of the dispensing member (which can even be a flat horizontal surface), the size of the aperture and the location of the aperture in relation to the vertical distance between the aperture and the cover of the container. This vertical distance is ascertained when the cover closes the opening.

If the slope and aperture size are too large, the pills will have a greater tendency to fall back to the bottom of the container when the container is turned upright again. It is preferred that this vertical distance, slope and aperture size be such as to limit the number of pills dispensed or relocated to one or two. Any one or more of the variables of vertical distance from aperture to cover, slope of the outer surface, or aperture size can be adjusted in order to control the amount of dispensed items. For example, aperture size and the vertical distance between the aperture and the cover can be controlled to limit the number of items dispensed at one time. Illustrations of this are in FIGS. 1, 2*a* and 10 where the vertical distance from the aperture to the cover is limited such that after one pill is dispensed, the dispensed pill acts to block the dispensing of further pills.

The dispensing action in accordance with this invention is accomplished by first inverting the covered container. This action ultimately places an item, for example, a tablet, adjacent the inner surface of the dispensing member. The item can then pass through the aperture of the dispensing member and be positioned on the upper surface of the dispensing member for ready removal. In some instances, mere inversion of the container may be insufficient to displace the item through the aperture. Therefore, it may be necessary to slightly agitate or shake the container in order to pass an item through the aperture. The container is then turned back into its original position (covered opening of container facing upward) and the item is disposed along the outer surface of the dispensing member. The cover of the container is then removed and one can easily take the item off the top surface, regardless of whether the surface is in the container or cover.

Referring now to the drawings, in all of which like parts are designated by like reference numerals, and referring particularly to FIGS. 1–4, the dispensing member of this invention is particularly adapted for use as a pill dispenser and as herein described and illustrated comprises a bottle, vial, or container 10. The bottle, vial, or container 10 may be made of any suitable, well known material such as glass or plastic. The upper end containing the opening of the bottle 10 can be covered by a cover (cap or lid) 12 which is removable and adapted to fit snugly over the container 10. The cover 12 is generally made of a resilient material such as a plastic. The bottle, vial or container 10 is adapted to contain undispensed pills 22.

Adjacent the open end of the bottle 10 is a dispensing member 14. Outer surface 16 of the dispensing member 14 is a frusto-conical shape which slopes downward and terminates at a centrally located circular aperture 20. The inner surface 18 of the dispensing member 14 is also a frusto-conical section which slopes downward from the aperture 20 to the container wall. Around the aperture 20 of the dispenser 14 is a slightly raised rim 24.

FIG. 2 shows the container 10 of FIG. 1 in the inverted position. By gravity, the undispensed pills 22 fall to rest adjacent the inner surface 18 of the dispensing member 14. One or more dispensed pills 26 can thus pass through the aperture and rest on the bottom surface of the cover 12 between the cover 12 and the outer section 16 of the dispensing member 14.

FIG. 2*a* illustrates the embodiment of the invention referred to hereinbefore in which the vertical distance from the aperture 20 to the cover 12 is limited such that after one pill 26 is dispensed, a portion of the dispensed pill 26 within the aperture blocks the adjacent pill 22*a* such that the dispensing of further pills is prevented.

FIG. 5 shows another embodiment of this invention. The dispensing member 28 has an inner surface 30 that slopes downward from the wall of the container 10 to the aperture 20 to form a convex surface.

FIG. 6 shows still another embodiment of this invention. In FIG. 6, the dispensing member 32 has a flat inner surface 34. As shown in FIGS. 1, 5, 7 and 8, the dispensing member is retained in position in the upper position of the container 10 by a snug, friction fit, and by the slight slope or outward flare of the container walls at the opening. However, as shown in the embodiment of FIG. 6, the dispensing member 32 could also be provided with a flange 36 which rests on the top of the container wall.

FIG. 7 shows still another embodiment of this invention. In this figure, the dispensing member 38 has a baffle 40 on the inner surface 42. The baffle is aligned directly under the aperture 20. This arrangement allows the dispensing of a single pill or tablet each time the container is inverted, since it is not possible for more than one pill at a time to pass under the baffle so long as the baffle is not too far from the bottom surface 42 of the dispenser, i.e., less than two times the width or thickness of the item to be dispensed. The length of the baffle would generally correspond to the diameter of the aperture. The length of the baffle can be slightly longer or shorter than the aperture diameter, but not so long as to inhibit dispensing, or so short as to be ineffective.

In FIG. 8, the container cover 44 is connected directly to the dispensing member 46 by a flexible hinge 48 which passes through a slot 50 in the container wall.

In FIG. 9, the outer surface of the dispensing member 52 forms a partial frusto-conical section and is integral with the container.

FIGS. 10, 11 and 12 all show dispensing members 54, 56 and 62 respectively, located in the lid for the containers 10. In the embodiments shown in FIGS. 10 and 11, once the item is disposed on the outer surface 58 and 60 respectively of the dispensers 54 and 56 the dispenser lid must be removed and agitated so that the item can pass back through the aperture 20. Alternatively, the diameter of the aperture 20 can be of such size to permit relatively easy removal of the dispensed pill without requiring agitation.

As shown in FIG. 11, the inner surface of lid 56 has a triangular configuration, however, any configuration can be employed, such as a flat surface.

FIG. 12 illustrates a form of the present invention in which the dispensing member 62 is removably engageable on the container 10 so as to function as a container cover, with the dispensing member 62 itself having a removably engageable lid 64. In this embodiment, once the item is positioned on the outer surface 66 of the dispensing member 62, no agitation of the container 10 or cover is required. The removably engageable lid 64 is then removed and the item can easily be taken away. Although surface 66 is depicted in FIG. 12 as having a downward slope toward aperture 20, surface 66 can also have other configurations such as a flat or curved (concave) configuration.

FIGS. 13, 14 and 15 illustrate dispensing members in which the aperture is not centrally located. The apertures 20 in FIGS. 13 and 14 are located at the side of the container 10. The dispensing member 68 of FIG. 13 has a sloped outer surface 70. The dispensing member 72 of FIG. 14 has a flat outer surface 74. As can be seen in FIG. 15, which shows a top view of dispensing members 68 and 72, the aperture 20 is a truncated circular section.

Figure 17:
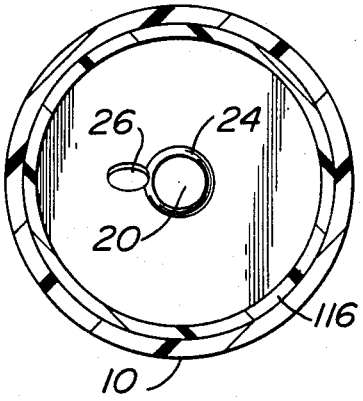
FIG. 17 is a top plan view of the dispensing apparatus shown in FIG. 16.

FIGS. 16 and 17 depict a dispenser member 112 in which its outer surface 114 is generally flat and generally perpendicular to its side wall 116. The length of side wall 16 can be utilized as an indicator to position the dispenser member 112 from the top opening of the container 10.

In FIGS. 18–21, dispensing apparatus for dispensing two different types of items are shown. The container 10 is segmented into two sections by a longitudinal partition 76. Each section has its own dispensing members 78 and 80 associated therewith. In FIGS. 20–21, the apertures 20 of dispensing members 78 and 80 are off-center and disposed to one side to facilitate pill dispensing upon tilting of the container 10.

In FIGS. 22 and 23, a dispenser having a flat disc dispensing member 82 with numerous flexible nipples 84 disposed on the outer surface thereof is shown. The flexible nipples 84 allow for accomodation of dispensing member 82 in various diameter sizes of container 10. For a larger container than that depicted in FIG. 23, the nipples would extend anywhere from 90° to 180° relative to member 82.

In FIGS. 24 and 25, a dispensing member 86 is shown. Member 86 is a circular flat member having a diameter smaller than container 10. Flanges 88 on either side of member 86 secure member 86 to the container 10. A pill 26 thus passes through annular space 90 to rest upon member 86.

FIGS. 26 and 27 depict a dispenser apparatus in which a ridge 92 is formed on at least part of the circumference of the container 10 adjacent to the opening of container 10. When the container is tilted, an undisposed pill 22 from the bottom of container 10 is captured on the ridge 92 as the container 10 is righted. The ridge 92 is of sufficient size and shape to accommodate a dispensed pill 26. The ridge 92 can be composed of projections or spaced fingers disposed around the circumference of the container 10. It is preferred that the ridge 92 have a dish-like configuration.

Depicted in FIGS. 28 and 29 are two further embodiments of the dispenser apparatus of the general nature as shown in FIG. 26. In FIG. 28, a thick internal wall 118 of container 10 forms the circumferential ridge 92. Alternatively, in FIG. 29, ridge 92 is formed as a projection from the thin internal wall of container 10.

In FIGS. 30–32, a dispensing member 94 is depicted. Dispensing member 94 is a flexible disc which is convex when in free form (see FIG. 31) and becomes concave (see FIG. 30) when inserted in a container 10 having a smaller diameter than the diameter of member 94.

A dispensing member 96 having a taper on its outer circumference is shown in FIGS. 33–34. If member 96 were placed in a container 10 having a smaller diameter than the diameter of member 96, then member 96 would have a convex configuration such as shown in FIG. 31.

In FIGS. 35–36, a dispensing member 98 having alternating thin and thicker radial elements, respectively 100 and 102, is shown. The thin elements 100 buckle when the dispensing member 98 is inserted in a container 10 which has a larger diameter than member 98 (see FIG. 36).

In FIGS. 37–38, a dispensing member 104 composed of two annular rings 106 and 108 separated by a live flexible hinge 110 is depicted. The hinge buckles when the dispensing member 104 is inserted in a container 10 having a larger diameter than the member 104.

The present invention offers many advantages. Pills can now be taken out of a vial without having to put one's fingers into the bottom of the vial and thus contaminate any of the pills. Also, people who suffer from arthritis or who would otherwise have difficulty in removing pills from bottles, can now easily take their needed medication. Furthermore, by use of this invention, the required number of pills can be dispensed thus reducing pill contamination due to the dispensing of unused pills which must be returned to the pill vial.

As used herein, "frusto-conical" is not intended to be limited to a flat surface, but may include a slightly curved (e.g., concave or convex) surface or a surface with ridges, grooves, undulations or other surface contours.

The present invention may be embodied in other specific forms without departing from the spirit or essential attributes thereof and, accordingly, reference should be made to the appended claims, rather than to the foregoing specification, as indicating the scope of the invention.

I claim:

1. A dispenser apparatus for dispensing at least one item at a time which comprises:

(a) a container having walls and an opening at least at one end thereof through which items can be dispensed with an openable cover overlying said opening, said container holding items for dispensing; and (b) a dispensing member positioned between the container opening and the items in the container, the member having at least one generally centrally positioned aperture extending therethrough, said aperture being at least slightly larger than the diameter of the largest item to be dispensed, said cover being directly connected to said dispensing member by a flexible hinge, said hinge passing through an opening in the wall of the container, said member having an inner surface juxtaposed to said held items and an outer surface juxtaposed to said container opening, said inner surface being generally flat and perpendicular to the container walls said outer surface sloping downwardly toward said aperture to form at least a partial frusto-conical concave section to support at least one dispensed item which passes through said aperture when said container is turned upside down and then turned at least partially rightside up with said cover over said opening, whereby said dispensed item is available for access on said outer surface upon the disengagement of said cover from said container.

2. A dispenser and relocator apparatus for dispensing at least one item at a time which comprises a container having sidewalls for holding items to be dispensed, said container having an opening at least at one end thereof through which said items can be dispensed, said container having an inwardly extending ridge adjacent to and extending generally around the circumference of the opening of said container, said ridge being integral with and formed from the internal portion of the container sidewalls to define an annular, radially inwardly extending shoulder of sufficient size and shape to capture one or more of said items upon tilting and at least partially righting of said container, whereby said shoulder supports the one or more items so that at least one dispensed item is available for access on said shoulder.

3. Apparatus according to claim 2 wherein said shoulder forms an angle with respect to said sidewalls of about 90°.

4. Apparatus according to claim 2 further comprising a raised rim on the supporting surface of said shoulder surrounding the inner periphery of said shoulder, said raised rim having a height less than the central cross-sectional dimension of said items to be dispensed.

5. Apparatus according to claim 2 wherein said apparatus is made of a rigid, pliable plastic.

6. Apparatus according to claim 2 wherein said items are pills.

7. Apparatus according to claim 2 wherein the support surface of said shoulder forms at least a partial frusto-conical section terminating in a central aperture larger than the size of said items to be dispensed.

8. Apparatus according to claim 7 wherein said support surface slopes from said sidewalls to said aperture in a direction away from said opening.

9. Apparatus according to claim 8 wherein said slope is at an angle from the horizontal of between about 10° and about 35°.

10. A one-piece apparatus for dispensing at least one item at a time which comprises a generally cylindrical container having sidewalls, a first portion of which are of a first diameter for holding items to be dispensed, said container having an opening at least at one end thereof through which said items can be dispensed, a second portion of the sidewalls of the container adjacent the opening being of a second diameter greater than the first diameter, a third portion of the sidewalls extending between the first and second sidewall portions to define an inwardly facing annular shoulder having an upper surface, the annular shoulder being of sufficient size and shape to capture one or more of said items upon tilting and at least partially righting of said container, said shoulder having an inward edge, said inward edge having a height extending from the surface of said shoulder toward the opening less than the central cross sectional dimension of said items to be dispensed, whereby said at least one dispensed item is available for access on the shoulder.

11. Apparatus according to claim 10 wherein said first sidewall portion forms an angle of about 90° with respect to said third sidewall portion.

12. Apparatus according to claim 11 wherein said second sidewall portion forms an angle of about 90° with respect to said third sidewall portion.

13. Apparatus according to claim 12 wherein a raised rim surrounds said inward edge of said shoulder, said raised rim having a height extending from the surface of said shoulder toward the opening less than the central cross-sectional dimension of said items to be dispensed.

14. A dispenser apparatus for dispensing only a single item at a time which comprises:

(a) a container having walls and an opening at least at one end thereof through which items can be dispensed with an openable cover overlying said opening, said container holding items for dispensing; and (b) a generally flat one piece dispensing member positioned proximate the container opening and above the items in the container, the member having at least one generally centrally positioned aperture extending therethrough, said aperture being at least slightly larger than the diameter of the largest item to be dispensed, said member having an inner surface juxtaposed to said held items and an outer surface juxtaposed to said container opening, said outer surface supporting a single dispensed item which passes through said aperture when said container is turned upside down and then turned at least partially rightside up with said cover over said opening, and distance between the outer surface of said member and the cover being sufficient to define a frusto-conically shaped area, the frusto-conically shaped area cooperating with said aperture so that substantially only a single item can be received on said outer surface, the single item normally at least partially blocking the aperture to prevent additional items from passing therethrough whereby said dispensed item is available for access on said outer surface upon the disengagement of said cover from said container.

15. Apparatus according to claim 14 further comprising a raised rim on said outer surface of said member surrounding said aperture, said raised rim having a height less than the central cross-sectional dimension of said items to be dispensed.

16. Apparatus according to claim 14 wherein said frusto-conically shaped area is defined by said outer surface of said member sloping from sidewalls of said container toward said aperture in a direction away from said opening.

17. Apparatus according to claim 16 wherein said slope is at an angle from the horizontal of between about 10° and about 35°.

18. Apparatus according to claim 14 wherein said frusto-conically shaped area is defined by said outer surface forming an angle of about 90° with respect to sidewalls of said container and said cover having an inner surface sloping from said sidewalls in a direction away from said aperture toward an apex axially aligned with said aperture.

19. Apparatus according to claim 18 wherein said slope is at an angle from the horizontal of between about 10° and about 35°.

20. A one piece apparatus for dispensing at least one discrete item at a time comprising a container having sidewalls for holding items to be dispensed, said container having an opening at least at one end thereof through which said items can be dispensed, said container having a radially inwardly extending ridge having an upper surface and extending generally about the inner surface of said container, said ridge defining an upper portion and a lower portion of said container, said ridge having an inward edge, the inward edge of said ridge defining a central aperture larger than the size of said items to be dispensed so that at least one item can pass through said aperture, said ridge being of sufficient size and shape to capture said items passing through said aperture upon tilting and at least partially righting of said container, said inward edge of said ridge having a height extending from the upper surface of said ridge less than the central cross sectional dimension of said items to be dispensed, whereby said ridge supports said items so that said dispensed items are easily available for access through said container opening.

21. Apparatus according to claim 20 wherein an angle is formed between said ridge and said sidewalls of about 90°.

22. Apparatus according to claim 20 further comprising a raised rim around said aperture having a height less than the central cross-sectional dimension of said items to be dispensed.

23. Apparatus according to claim 20 wherein said apparatus is made of a rigid, pliable plastic.

24. Apparatus according to claim 20 wherein said items are pills.

25. The apparatus of claim 20 wherein said upper surface of said ridge forms at least a partial frusto-conical section terminating in said aperture.

26. Apparatus according to claim 25 wherein said upper surface slopes from said sidewalls toward said aperture in a direction away from said opening.

27. Apparatus according to claim 26 wherein said slope is at an angle from the horizontal of between about 10° and about 35°.

* * * * *